US006809256B2

(12) United States Patent
Garland

(10) Patent No.: US 6,809,256 B2
(45) Date of Patent: Oct. 26, 2004

(54) AUDIO CABLE

(76) Inventor: John Garland, P.O. Box 1012, Allyn, WA (US) 98524

( * ) Notice: Subject to any disclaimer, the term of this patent is extended or adjusted under 35 U.S.C. 154(b) by 0 days.

(21) Appl. No.: 10/648,612

(22) Filed: Aug. 26, 2003

(65) Prior Publication Data

US 2004/0045731 A1 Mar. 11, 2004

Related U.S. Application Data

(60) Provisional application No. 60/406,402, filed on Aug. 27, 2002.

(51) Int. Cl.[7] ..... H01B 7/29

(52) U.S. Cl. ..... 174/36; 174/102 R; 174/35 C

(58) Field of Search ..... 174/35 C, 113 R, 174/36, 102 R, 115, 114 R, 102 SP, 27, 113 AS; 439/607, 608, 609, 610

(56) References Cited

U.S. PATENT DOCUMENTS

| | | | | | |
|---|---|---|---|---|---|
| 1,305,247 | A | | 6/1919 | Beaver et al. | |
| 3,448,222 | A | | 6/1969 | Greber | 174/42 |
| 4,477,693 | A | * | 10/1984 | Krabec et al. | 174/36 |
| 4,538,023 | A | | 8/1985 | Brisson | 174/115 |
| 4,954,095 | A | | 9/1990 | Cogan | 439/284 |
| 5,030,794 | A | * | 7/1991 | Schell et al. | 174/36 |
| 5,247,270 | A | * | 9/1993 | Harman et al. | 174/36 |
| 5,266,744 | A | | 11/1993 | Fitzmaurice | 174/103 |
| 5,376,758 | A | | 12/1994 | Kimber | 174/128.1 |
| 5,393,933 | A | | 2/1995 | Goertz | 174/117 R |
| 5,491,299 | A | * | 2/1996 | Naylor et al. | 174/36 |
| 5,606,151 | A | | 2/1997 | Siekierka et al. | 174/113 R |
| 5,929,374 | A | * | 7/1999 | Garland | 174/28 |
| 6,066,799 | A | | 5/2000 | Nugent | 174/27 |
| 6,147,309 | A | * | 11/2000 | Mottine et al. | 174/113 R |
| 6,225,563 | B1 | | 5/2001 | Poulsen | 174/117 |
| 6,248,954 | B1 | | 6/2001 | Clark et al. | 174/113 |
| 6,545,213 | B1 | * | 4/2003 | Gabriel | 174/36 |
| 6,653,555 | B2 | * | 11/2003 | Nugent | 174/27 |

* cited by examiner

*Primary Examiner*—Dean A. Reichard
*Assistant Examiner*—Angel R. Estrada
(74) *Attorney, Agent, or Firm*—Dean A. Craine

(57) ABSTRACT

An improved audio cable comprising at least one pair of first and second insulated conductors located on opposite sides of a shielding member that extends the entire length of the cable. The first and second conductors are located on opposite sides of the shielding member. Bores, also called lenses, are formed on the shielding member that allow exposure of the magnetic fields of the first and second conductors to reduce inductance. In the first embodiment, the shielding member is a flat structure twisted into spiral with the conductors on opposite sides of the shielding member. The conductors and shielding member may be covered with an outer shielding member that only extends over the lenses or the entire length of the cable and covered by a durable, protective outer cover.

18 Claims, 3 Drawing Sheets

AUDIO CABLE

This utility patent application claims the benefit of the provisional patent application (Ser. No. 60/406,402) filed on Aug. 27, 2002.

BACKGROUND OF THE INVENTION

1. Field of the Invention

The present invention relates generally to the field of audio electronics, and more particularly, to audio cables.

2. Description of the Related Art

Heretofore, there have been two general classes of audio cables—shielded or non-shielded. There are known advantages and disadvantages to both classes.

It is commonly known that single or multiple shields lower RF and EM interference in audio cables. When shields run parallel to the conductors, a synthesized proximity effect is created that is a spectral detriment to the normal flow of electrons through the conductors. This negatively effects the frequency balance.

It is known by the inventor that the capacitance and inductance of unshielded conductors in an audio cable negatively impacts the audio characteristics of the cable. One possible method used to reduce capacitance is to magnetically shield the conductors from each other for the entire length of the cable. Unfortunately, the use of a continuous shield between the two conductors increases inductance that negatively impacts audio characteristics of the cable.

What is needed is an improved audio cable with shielded conductors that have relatively low capacitance and low inductance, and that are definitively defined rather than mathematically averaged over the length of the cable.

SUMMARY OF THE INVENTION

It is an object of the present invention to provide an improved audio cable that uses shielded conductors.

It is another object of the invention to provide such an audio cable that has relatively low capacitance and low inductance.

It is a further object of the present invention to provide such an audio cable wherein the capacitance and inductance are definitively defined rather than mathematically determined by averaging the capacitance and inductance over the entire length of the cable.

These and other objects of the present invention are met by an improved audio cable disclosed herein comprising at least one pair of first and second conductors that extend continuously along the cable. Located between the two conductors is a shielding means that extends substantially the entire length of the cable. Formed in the shielding means is at least one small opening, hereinafter called a lens, which exposes the magnetic fields of the two conductors to each other. By continuously shielding the two conductors and then briefly exposing their magnetic fields of the conductors to each other, both the capacitance and inductance of the conductors are reduced thereby improving their overall audio characteristics of the cable. A suitable connector plug is attached to the opposite ends of the conductors that enables the ends of the cable to connect to the audio equipment.

In the first and second embodiments, the shielding means is a straight or spiral-shaped lead shielding member that extends the entire length of the cable. The conductors are spaced apart and located on opposite sides of the shielding member. Two lenses are formed near the opposites ends of the shielding member or one lens is formed at the center axis of the shielding member. The lenses are sufficient in size and shape to enable the conductors to be placed in close proximity or touch. In the preferred embodiment, the conductors extend through the lens and travel along the opposite sides of the shielding member. An optional outer shielding member may be placed around the conductors and lenses only or places over the entire length conductors to reduce outside interference.

In a third embodiment, the shielding means is a tubular member made of shielding material with a cathode conductor located inside and an anode conductor wrapped spirally around the tubular member. Extending from the end of the tubular member is a flat shielding member with a hole formed therein. During assembly, the conductors exit the tubular member on opposite sides of the flat shielding member and then extend through the hole and contact. The ends of the conductors then connect to a standard plug.

In yet another embodiment, the shielding means are two parallel tubular members made of shielding material that contain either a cathode conductor or an anode conductor. The ends of the tubular members terminate at the same location. A flat shielding member similar to the flat shielding member used with the third embodiment is placed between the two tubular members. When the conductors exit the tubular members, they travel on opposite sides of the flat shielding member and extend through the lens.

With each embodiment mentioned above, the length of the cathode and anode conductors may be manufactured in equal lengths.

DESCRIPTION OF THE PREFERRED EMBODIMENT(S)

Figure 1:
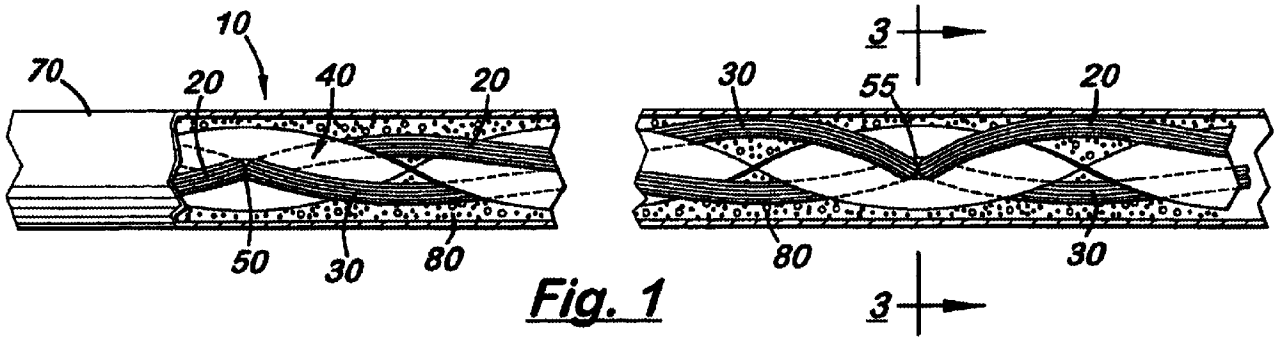
FIG. 1 is a sectional, side elevational view of the first embodiment of the improved audio cable disclosed herein.

Shown in the accompanying Figs. is a multiple conductor audio cable 10 comprising at least one pair of first and second conductors 20, 30, respectively, located on opposite sides of an elongated shielding member 40 that extends the entire length of the cable 10. In the first embodiment, shown in FIGS. 1–4, the first and second conductors 20, 30 extend parallel on opposite sides of a spiral-shaped shielding member 40 and extend through bores, also called lenses 50, to the opposite side of the shielding member 40.

The inventor has discovered that when a shielding member 40 extends continuously along an audio cable between the two conductors 20, 30 with a portion of it discontinued or removed a short distance so that magnetic fields of the first and second conductors 20, 30 are exposed to each other, the inductance of each conductor 20, 30 is substantially lowered. The inventor hereinafter refers to the removed or open portion of the shielding member 40 located between the two conductors 20, 30 as a lens 50. It is believed that when the shielding member 40 is removed and the two conductors 20, 30 are exposed to each other and moved closer together, their magnetic fields interact and lower the inductance. In the first embodiment, the first and second conductors 20, 30 extend completely through the lens 50 and make contact, thereby allowing their magnetic fields to optimally interact. When used with AC speaker systems, there are two lenses 50, 55 formed on opposite ends of the shielding member 40. When used with DC speaker system, one lens 50 may be sufficient when located at the center axis of the shielding member 40.

Figure 5:
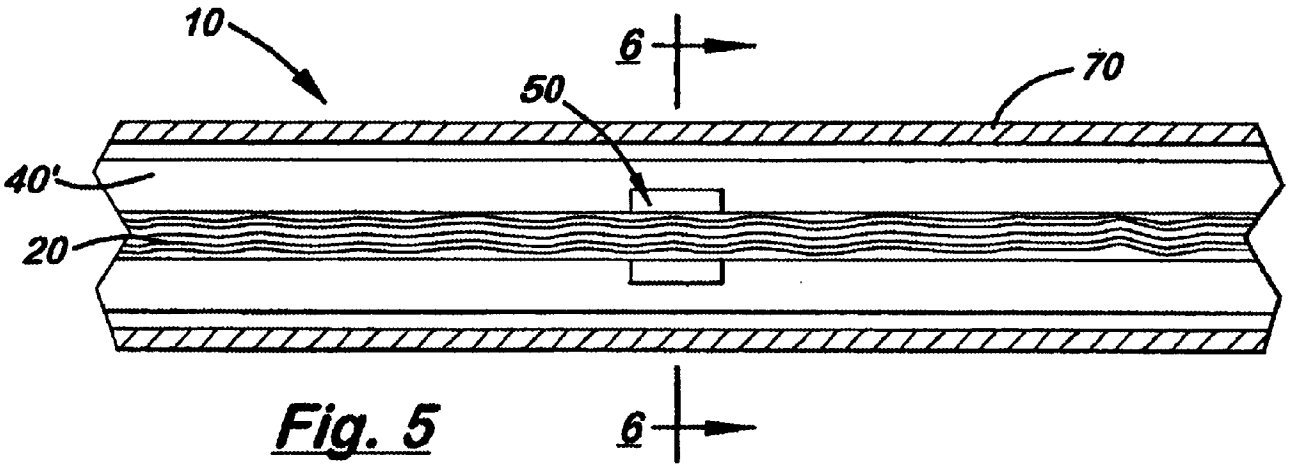
FIG. 5 is a sectional, side elevational view of the second embodiment of the improved audio cable.
Figure 6:
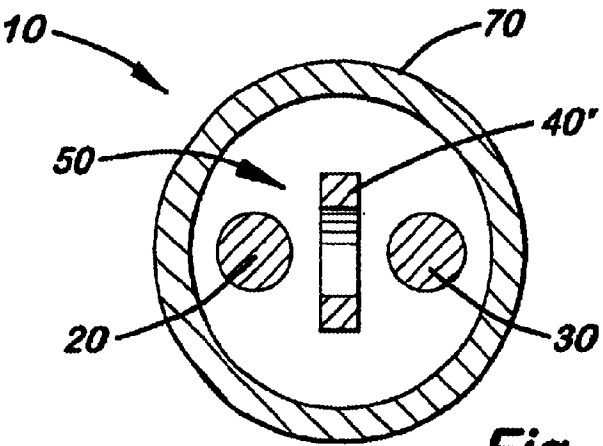
FIG. 6 is a sectional view of the invention taken along line 6—6 in FIG. 5.

As mentioned above, in the first embodiment the shielding member 40 is spiral-shaped and made of lead approximately 1 mm thick and 6 mm wide. The two conductors 20, 30 extend and twist on opposite sides of the shielding member 40. The conductors 20, 30 extend through the lenses 50, 55 and cross to the opposite side. In a second embodiment, shown in FIGS. 5–6, the shielding member referenced 40' is an elongated, flat, non-spiral structure with the first and second conductors 20, 30 disposed continuously on opposite sides of the shielding member 40'. In both embodiments, the lenses 50, 55 are circular, oval, or rectangular shaped bores which are sufficiently wide (approximately 2 mm) to allow the first and second conductors 20, 30 to cross and extend through the lenses 50, 55 to expose their respective magnetic fields. One advantage of using a spiral-shaped shielding member 40, rather than a flat non-spiral shielding member 40' is that the spiral-shaped shielding member 40 is easier to bend and twist thereby enabling the cable 10 to bend and twist to a desired shape more easily.

Figure 7:
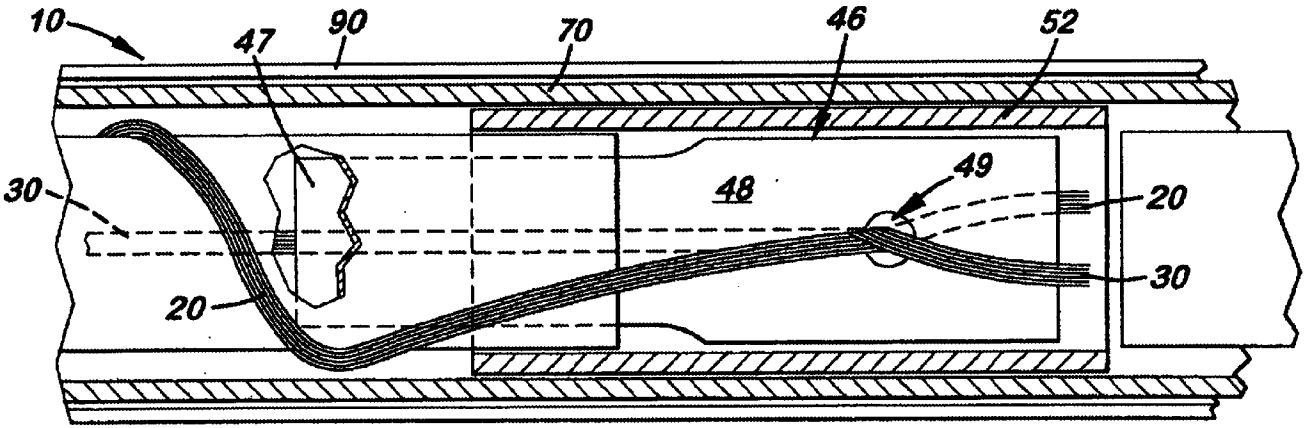
FIG. 7 is a sectional, side elevational view of the third embodiment of the invention that disposes the cathode conductor inside a tubular shielding member with the anode conductor twisted around the tubular member.
Figure 8:
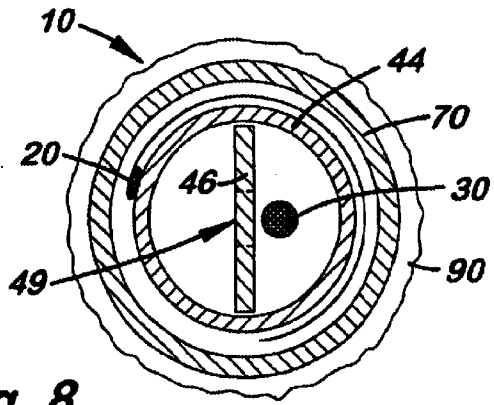
FIG. 8 is a sectional view taken along line 8—8 in FIG. 7

In a third embodiment of the invention shown in FIGS. 7 and 8, the shielding means is a tubular member 44 made of shielding material such as lead or copper with a cathode conductor 30 located inside and an anode conductor 20 wrapped spirally around the outside surface of the tubular member 44. Extending from the ends of the tubular member 44 is a longitudinally aligned flat shielding member 46. The flat shielding member 46 includes a narrow neck 47 and fits tightly into the end of the tubular member 44. Formed on the opposite end of the flat shielding member 46 is a wide body section 48 that extends from the end of the tubular member 44. Formed on the wide body section 48 is a lens 49 that allows the conductors 20, 30 to extend through and contact.

Located around the wide body section 48 is a short, cylindrical shielding member 52 that shields the lens from outside EM and RF interference.

Figure 9:
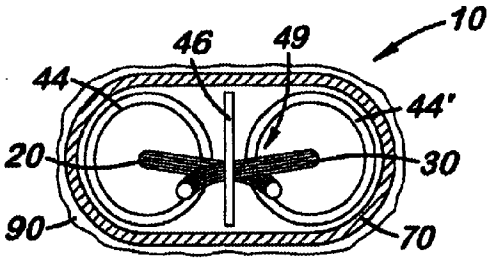
FIG. 9 is a sectional view of a fourth embodiment of the invention that uses two tubular members with a conductor disposed inside each conductor that connect at a flat shielding member located at the ends of the two tubular members.

In a fourth embodiment, shown in FIG. 9, the shielding means are two tubular members 44, 44' made of shielding material that contain an anode conductor 20 and a cathode conductor 30. The two tubular members 44, 44' are approximately the same length. Located at the opposite ends of the two tubular members 44, 44' is a longitudinally aligned flat shielding member 46 as described above with a lens 49 formed thereon.

In the first, second and third embodiments described above, the first and second conductors 20, 30 and shielding members 40, 40', 44, 44' are covered by a durable protective outer cover 70 made of poly propylene. An optional outer shielding means, such as lead "shots" or beads 80, may be disposed between the outer cover 70 and the conductors 20, 30 to provide additional shielding. The optional shielding means may extend the entire length of the cable or just over the lenses as shown in FIG. 7. The inventor has discovered that when optional outer shielding means is used, the lenses 50, 55 are shielded from R.F. and E.M. interference, which improves bass, dimensionality and overall ambiance. An attractive outer fabric layer 90 may be used over the outer cover 70.

Figure 2:
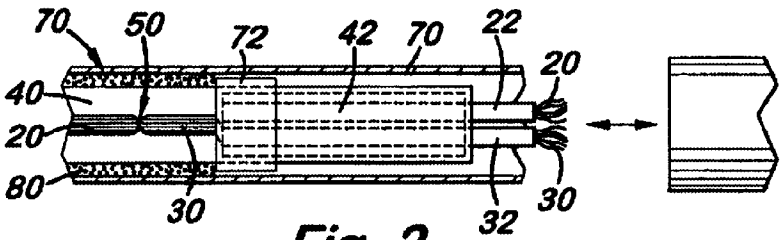
FIG. 2 is a sectional side elevational view of the distal end of the cable.
Figure 4:
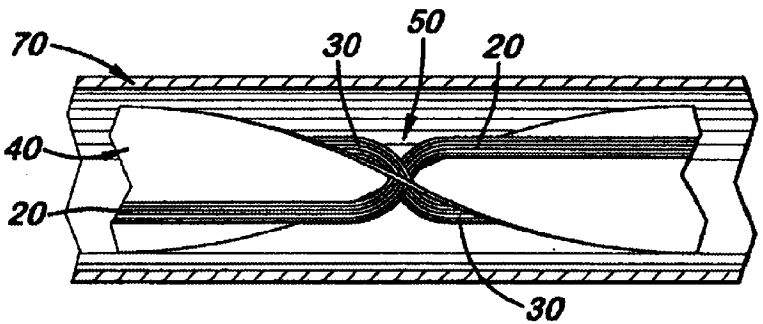
FIG. 4 is a top plan view of a section of the cable.
Figure 3:
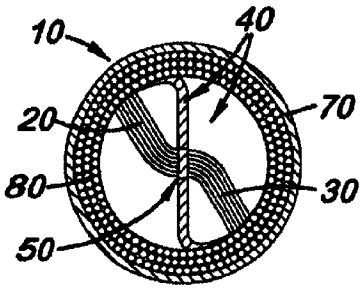
FIG. 3 is a sectional view of the invention taken along line 3—3 in FIG. 1.

It should be understood however, that the length of the cable 10, number and size of the lenses 50, and the number of conductors 20, 30 are not limited. The number of strands of wire in each conductor 20, 30 may vary. The individual strands in the wire may be individually insulated with a gel coat or other suitable insulating material. As shown in FIG. 2, at the distal end of the cable 10, the two conductors 20, 30 may also extend through a crimp nut 72 and a longitudinally aligned bushing 42. Additional insulation 22, 32 may also be disposed around the conductors 20, 30, respectively, to prevent shorts.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An improved audio cable, comprising:

a. a first conductor;

b. a second conductor; and, c. a shielding member extending longitudinally and disposed between said first and second conductor, said shielding member being made of material capable of shielding EM and RF energy, said shielding member includes at least one lens that exposes said conductors to each other and thereby reducing inductance in said conductors while maintaining a relatively low capacitance.

2. The audio cable, as recited in claim 1, wherein said shielding member is flat and spiral-shaped with said first and second conductors located on opposite sides thereof.

3. The audio cable, as recited in claim 2, wherein said shielding member is made of lead.

4. The audio cable, as recited in claim 2, wherein said audio cable further includes a second lens, said first and second lenses being formed on the opposite ends of said shielding means.

5. The audio cable, as recited in claim 1, further including an outer shielding means located around said lens.

6. The audio cable, as recited in claim 1, wherein said shielding member is a tubular member.

7. The audio cable, as recited in claim 6, wherein said first conductor is located inside said tubular member and said second conductor is located over the outside surface of said tubular member.

8. The audio cable, as recited in claim 6, wherein said tubular member is made of lead.

9. The audio cable, as recited in claim 6, wherein said tubular member includes at least one flat shielding spacer located at an open end of said tubular member with a lens formed on said spacer that exposes said conductors enables the electromagnetic fields therefrom to interfere.

10. The audio cable, as recited in claim 1, further including an outer cover that extends the length of said cable to cover said first and second conductors and said shielding means.

11. The audio cable, as recited in claim 10, further including a protective layer located around said outer cover.

12. The audio cable, as recited in claim 1, wherein said first and second conductors within said audio cable are identical lengths.

13. The audio cable, as recited in claim 4, further including an outer shielding means that extends the length of said cable to cover said first and second conductors and said shielding member.

14. The audio cable, as recited in claim 1, wherein said shielding member comprises two adjacent tubular members made of shielding material with said first and second conductors being located inside said tubular members.

15. The audio cable, as recited in claim 14, further including a longitudinally aligned flat shielding member located at the open ends of said tubular members, said flat shielding member including a bore that allow said first and second conductors to extend through and contact each other.

16. The audio cable, as recited in claim 15, further including an outer cover that extends the length of said cable and covers said conductors and said shielding member.

17. The audio cable, as recited in claim 15, further including an outer fabric layer that extends the length of said cable to cover said tubular member and said conductors.

18. An improved audio cable, comprising:

a. an outer cover;

b. a first conductor extending the entire length of said outer cover;

c. a second conductor extending the entire length of said outer cover; and, d. a shielding member extending longitudinally along the length of said outer cover and disposed between said first and second conductor, said shielding member being made of material capable of shielding EM and RF energy, said shielding member includes two lenses, said lenses being located at opposite ends of said cable that allows said first conductor and said second conductor to contact to reduce their inductance and maintain a relatively low capacitance.

* * * * *